US008089416B2

(12) United States Patent
Chung et al.

(10) Patent No.: US 8,089,416 B2
(45) Date of Patent: Jan. 3, 2012

(54) DIPOLE ANTENNA

(75) Inventors: Shyh-Jong Chung, Hsinchu (TW); Ching-Wei Ling, Tainan County (TW); Yi-Shiang Ma, Changhua County (TW)

(73) Assignee: Industrial Technology Research Institute, Hsinchu (TW)

( * ) Notice: Subject to any disclaimer, the term of this patent is extended or adjusted under 35 U.S.C. 154(b) by 386 days.

(21) Appl. No.: 12/371,900

(22) Filed: Feb. 16, 2009

(65) Prior Publication Data

US 2010/0156736 A1 Jun. 24, 2010

(30) Foreign Application Priority Data

Dec. 23, 2008 (TW) ..... 97150318 A

(51) Int. Cl.
*H01Q 9/16* (2006.01)

(52) U.S. Cl. ..... 343/793; 343/822

(58) Field of Classification Search ..... 343/793, 343/795, 822

See application file for complete search history.

(56) References Cited

U.S. PATENT DOCUMENTS

| | | | | |
|---|---|---|---|---|
| 7,548,167 | B2 * | 6/2009 | Yamagajo et al. | 340/572.8 |
| 7,659,863 | B2 * | 2/2010 | Kai et al. | 343/795 |
| 7,750,862 | B2 * | 7/2010 | Hilgers | 343/726 |
| 2005/0024287 | A1 | 2/2005 | Jo et al. | |
| 2005/0093678 | A1 | 5/2005 | Forster et al. | |
| 2010/0134292 | A1 * | 6/2010 | Deavours | 340/572.7 |

OTHER PUBLICATIONS

Authored by Ukkonen , et al., article titled "Operability of Folded Microstrip Patch-Type Tag Antenna in the UHF RFID Bands Within 865-928 MHZ," adopted from Antennas Wireless Propagation Letter, vol. 5, No. 1, pp. 414-417, Dec. 2006.

Authored by Subramanian, et al., article titled "Progress toward development of all-printed RFID tags: materials, processes, and devices," adopted from Proceedings of the IEEE, vol. 93, No. 7, Jul. 2005, pp. 1330-1338.

Authored by Son, H.W., et al., article titled "Design of RFID tag antennas using an inductively coupled feed," adopted from Electronics Letters, vol. 41, No. 18, pp. 994-996, Sep. 2005.

Authored by Li Yang, et al., article titled "Design and development of novel inductively coupled RFID antennas," adopted from Proc. in Antennas and Propagation Society International Symposium, Jul. 9-14, 2006, pp. 1035-1038.

Authored by C. Cho, et al., article titled "Broadband RFID tag antenna with quasi-isotropic radiation pattern," adopted from Electronics Letters, vol. 41, No. 20, pp. 1091-1092, Sep. 2005.

"Office Action of Taiwan Counterpart Application", issued on Sep. 9, 2011, p. 1-p. 6, in which the listed references were cited.

Björninen et al., "Design and RFID Signal Analysis of a Meander Line UHF RFID Tag Antenna", Antennas and Propagation Society International Symposium, Jul. 5-11, 2008, pp. 1-4.

* cited by examiner

*Primary Examiner* — Tan Ho

(74) *Attorney, Agent, or Firm* — Jianq Chyun IP Office

(57) ABSTRACT

A dipole antenna used in an operation frequency includes a dipole radiation main body, a first semi-loop metal line and a second semi-loop metal line is provided. The dipole radiation main body has a first radiation line arm and a second radiation line arm aligned in a straight line, wherein a gap exists therebetween to form a feeding terminal. The first semi-loop metal line has two ends respectively connected to the first radiation line arm and the second radiation line arm to form a first matching loop covering the feeding terminal. The second semi-loop metal line has two ends respectively connected to the first radiation line arm and the second radiation line arm to form a second matching loop, which is larger than the first matching loop.

17 Claims, 11 Drawing Sheets

DIPOLE ANTENNA

CROSS-REFERENCE TO RELATED APPLICATION

This application claims the priority benefit of Taiwan application serial no. 97150318, filed on Dec. 23, 2008. The entirety of the above-mentioned patent application is hereby incorporated by reference herein and made a part of specification.

BACKGROUND OF THE INVENTION

1. Field of the Invention

The present invention relates to a dipole antenna, which can be applied to an ultra-high frequency (UHF) band.

2. Description of Related Art

The radio frequency identification (RFID) tag is widely used nowadays, for example, passports, transportation payments, and product tracking. The function of the RFID tag is to transmit data to the remote terminal. Some of the RFID devices are applied in the UHF band (860-930 MHz). Usually, an RFID tag consists of an antenna and a chip IC. The most common type of the antenna is the dipole antenna.

Design of the dipole antenna is diversified. FIG. 1 is a schematic diagram illustrating a structure of a conventional dipole antenna. Referring to FIG. 1, the conventional dipole antenna includes a radiation metal line 100, wherein a size thereof corresponds to a required operation frequency. The conventional dipole further includes a rectangular loop 102. A distance between a middle area of the rectangular loop 102 and the radiation metal line 100 is d. One end of the rectangular loop 102 has an opening 104 served as a feeding terminal. The radiation metal line 100 and the rectangular loop 102 can be formed on a circuit board, for example, a printed RFID tag, which can be easily fabricated.

FIG. 2 is a schematic diagram illustrating an equivalent circuit of the dipole antenna of FIG. 1. Referring to FIG. 2, the feeding terminal 106 is connected to an external chip. The radiation metal line 100 is inductively coupled to the rectangular loop 102. A signal can be input through the feeding terminal 106, and can be sent out through the radiation metal line 100. Conversely, the radiation metal line 100 can receive the signal, and the feeding terminal 106 can output the signal.

Generally, the impedance of the chip IC is capacitive. In order to deliver the maximum power to the antenna, the impedance of the antenna must be designed to be inductive for conjugate matching. For different operating frequencies and the size reduction requirement, various antenna designs and matching techniques were developed.

SUMMARY OF THE INVENTION

The present invention is directed to a dipole antenna, in which a real part value and an imaginary part value matching a complex form input impedance Z of a chip can be easily adjusted.

The present invention provides a dipole antenna used in an operation frequency, which includes a dipole radiation main body, a first semi-loop metal line and a second semi-loop metal line. The dipole radiation main body has a first radiation line arm and a second radiation line arm aligned in a straight line, wherein a gap exists therebetween to form a feeding terminal. The first semi-loop metal line has two ends respectively connected to the first radiation line arm and the second radiation line arm to form a first matching loop covering the feeding terminal. The second semi-loop metal line has two ends respectively connected to the first radiation line arm and the second radiation line arm to form a second matching loop, which is larger than the first matching loop.

The aforementioned dipole antenna may have diversified variations, which at least includes variations described in following embodiments and claims.

In order to make the aforementioned and other objects, features and advantages of the present invention comprehensible, a preferred embodiment accompanied with figures is described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

The present invention provides a dipole antenna design based on the dipole antenna structure of the related art, which can easily adjust a real part value and an imaginary part value matching a chip impedance. Embodiments are provided below for describing the present invention, though the present invention is not limited to provide embodiments, and the provided embodiments can also be mutually combined.

Figure 1:
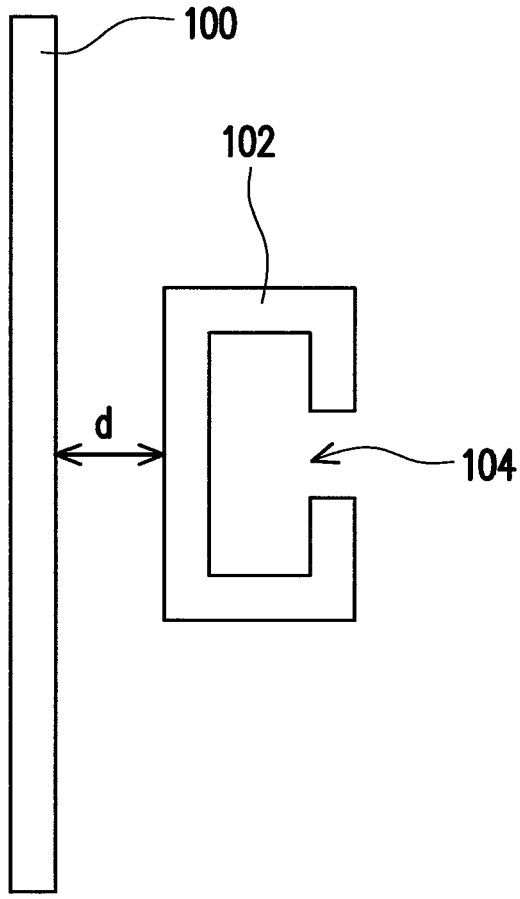
FIG. 1 (PRIOR ART)
FIG. 1 is a schematic diagram illustrating a structure of a conventional dipole antenna.
Figure 2:
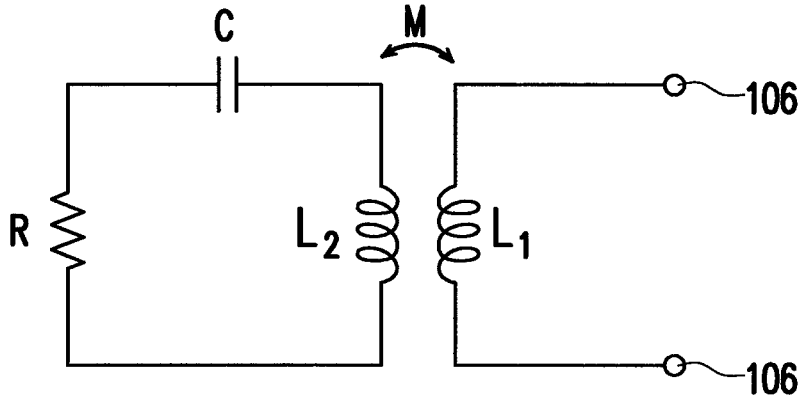
FIG. 2 (PRIOR ART)
FIG. 2 is a schematic diagram illustrating an equivalent circuit of the dipole antenna of FIG. 1.
Figure 3:
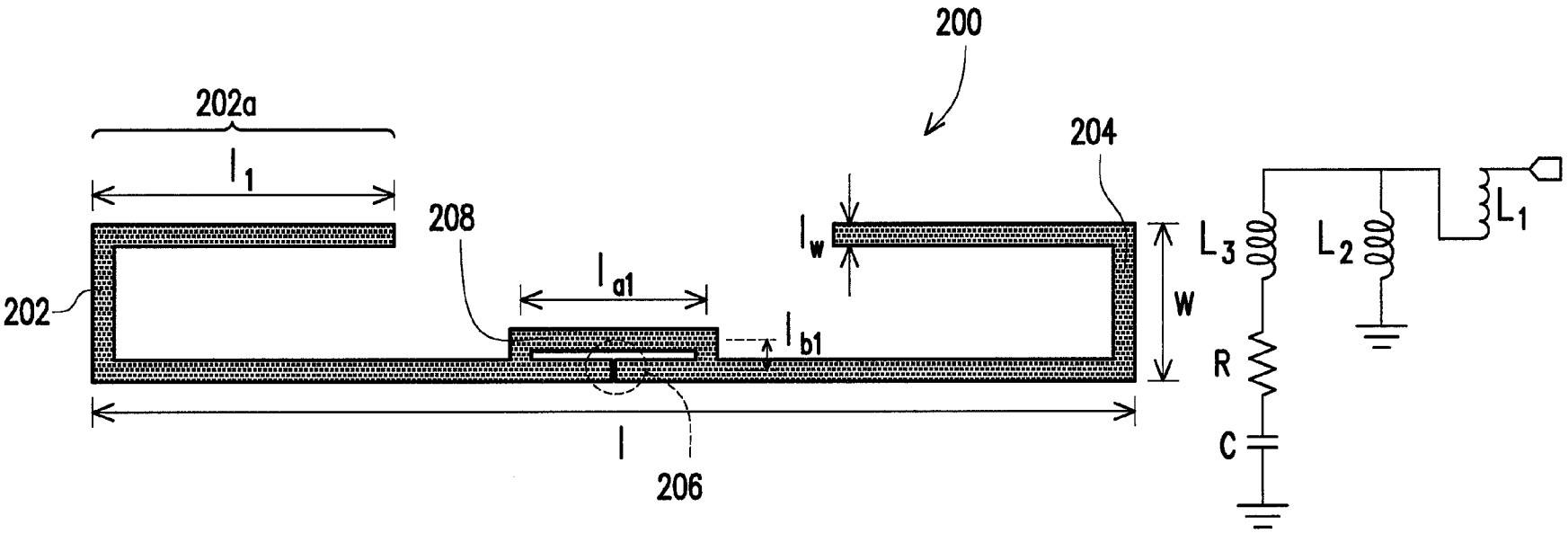
FIG. 3 is a schematic diagram illustrating a structure mechanism of a dipole antenna according to an embodiment of the present invention.

FIG. 3 is a schematic diagram illustrating a structure mechanism of a dipole antenna according to an embodiment of the present invention. Referring to FIG. 3, a radiation main body of the dipole antenna 200 has a first radiation line arm 202 and a second radiation line arm 204 aligned in a straight line, wherein a gap exits therebetween to form a feeding terminal 206. Lengths of the first radiation line arm 202 and the second radiation line arm are respectively a quarter of a wavelength of a corresponding operation frequency. A semi-loop metal line, such as a semi-rectangular metal line, has two ends respectively connected to the first radiation line arm 202 and the second radiation line arm 204 to form a matching loop 208. A right part of FIG. 3 is an equivalent circuit of the dipole antenna 200, which includes a capacitor (C), a resistor (R) and inductors (L). A function of the matching loop 208 is to preliminarily adjust a real part value R and an imaginary part value X of a matching impedance Z, wherein Z is a complex quantity represented by Z=R+jX.

Theoretically, the dipole antenna can provide an omnidirectional radiation pattern to receive electromagnetic signals of different angles. Taking a RFID antenna as an example, since impedances of most RFID chips are capacitive, in order to match the capacitive impedances of integrated circuits with various tags, an inductive effect generated by the imaginary part value X of the input impedance has to be considered during design of the antenna, so as to eliminate the capacitivity of the chip impedance. Referring to FIG. 3, the semi-loop metal line is connected to two ends of the feeding terminal 206 to form the first matching loop 208, which can be a rectangular matching loop 208. Based on a function of the matching loop 208, the input impedance of the antenna may have an inductance, and the real part value and the imaginary part value of the input impedance of the antenna can be adjusted. Generally, the real part value and the imaginary part value of the input impedance can be increased by increasing the size of the matching loop 208.

Taking the rectangular matching loop 208 as an example, the size and the line width can be adjusted by a few parameters, e.g. $l_{a1}$, $l_{b1}$, $l_w$, etc. In case of the RFID antenna, and the operation frequency thereof being a UHF band, for example, 915 MHz, the length of a single line arm is about a quarter of the wavelength of the corresponding operation frequency. Moreover, two tail parts of the line arms 202 and 204 can be bent towards a direction of the feeding terminal 206 to form a bending region 202*a*, by which an area of the dipole antenna 200 can be reduced. Moreover, by adjusting a size of the bending area 202*a*, the operation frequency can be further fine-tuned, wherein a result thereof is described later. The gap between the two line arms 202 and 204 is the feeding terminal 206. By adding the matching loop 208 to the feeding terminal 206, an inductance is generated, and the matching impedance can be adjusted. The real part input impedance of the dipole antenna is about 70 ohms, and the imaginary part impedance is capacitive. However, generally, the real part input impedance of the circuit chip is relatively small, and the imaginary part input impedance is relatively great and is capacitive. To achieve a maximum power output, the input impedance of the antenna is designed to be conjugated match. Namely, the input impedance of the antenna has to be inductive. Therefore, by applying the matching loop 208 to the feeding terminal 206, not only the input impedance of the whole antenna can be inductive, but also the real part impedance of the input impedance can be changed, so as to achieve a matching effect.

Figure 4:
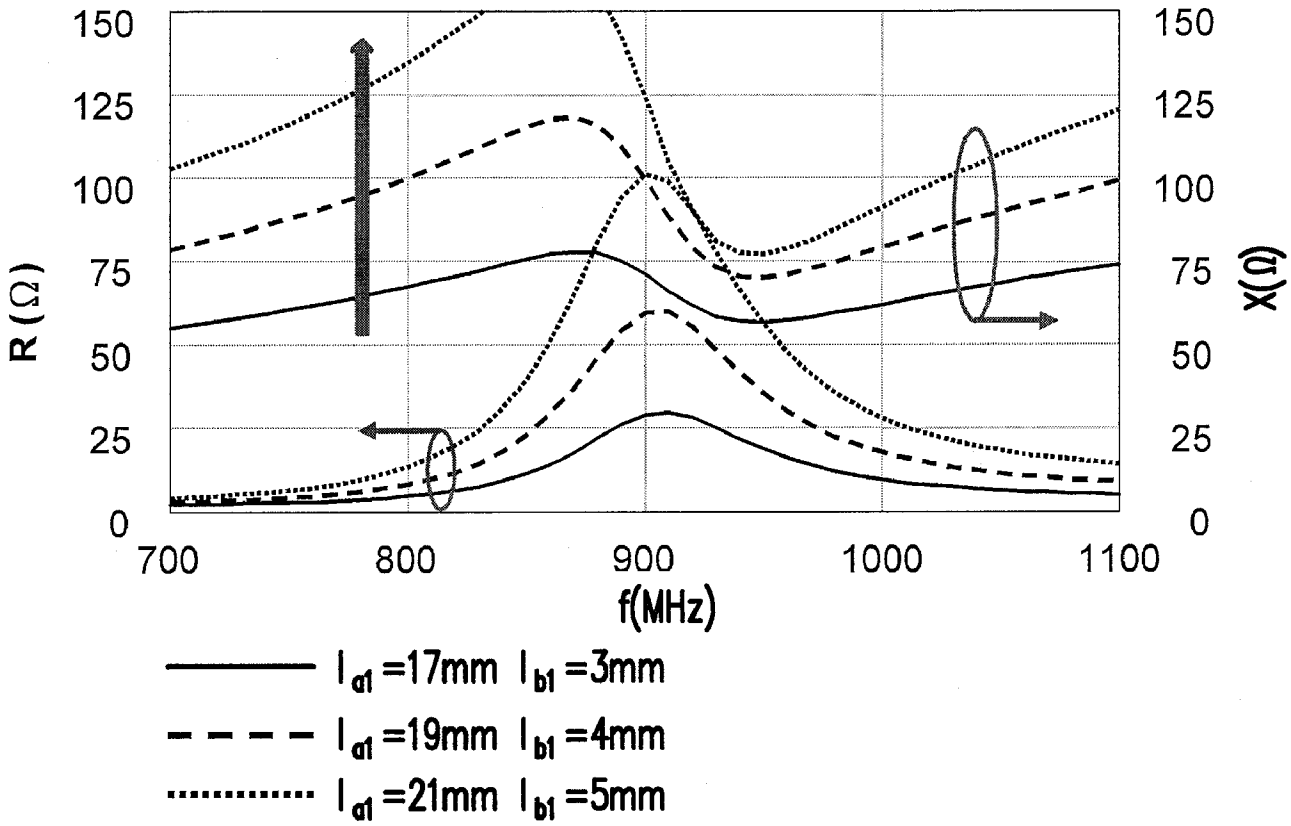
FIG. 4 is a schematic diagram illustrating variations of a real part value and an imaginary part value when structural parameters of an antenna of FIG. 3 are changed.

FIG. 4 is a schematic diagram illustrating variations of the real part value and the imaginary part value when structural parameters of the antenna of FIG. 3 are changed. Referring to FIG. 4, the solid lines represent that the real part value (R) and the imaginary part value (X) are varied along with the frequencies F in case that $l_{a1}$=17 mm, $l_{b1}$=3 mm, wherein the variation of the real part value (R) is represented by a lower solid line, and the variation of the imaginary part value (X) is represented by the upper solid line. Moreover, the dash lines represent variations of the real part value (R) and the imaginary part value (X) in case that $l_{a1}$=19 mm, $l_{b1}$=4 mm. The dot lines represent variations of the real part value (R) and the imaginary part value (X) in case that $l_{a1}$=21 mm, $l_{b1}$=5 mm. In addition, the other parameters are, for example, l=100 mm, w=15 mm, $l_1$=29 mm and $l_w$=2 mm. Accordingly, by increasing the size of the matching loop 208, the real part value (R) and the imaginary part value (X) are all increased. Regarding the line width, it is relatively simple to design the whole antenna into an equal line width. However, the line width can be varied according to actual requirement, so that the whole antenna is unnecessary to have the equal line width, and for the matching loop itself, the equal line width is also unnecessary.

According to the variations of FIG. 4, when the antenna is designed, a first matching loop 208 is first designed, so that the imaginary part value (X) can approach an actually required imaginary part value (X). However, since when the imaginary part value (X) of the impedance is adjusted, the real part value (R) of the impedance is also changed, during design of the antenna, how to adjust the real part value (R) has to be considered, so as to increase an adjusting freeness thereof.

Figure 5:
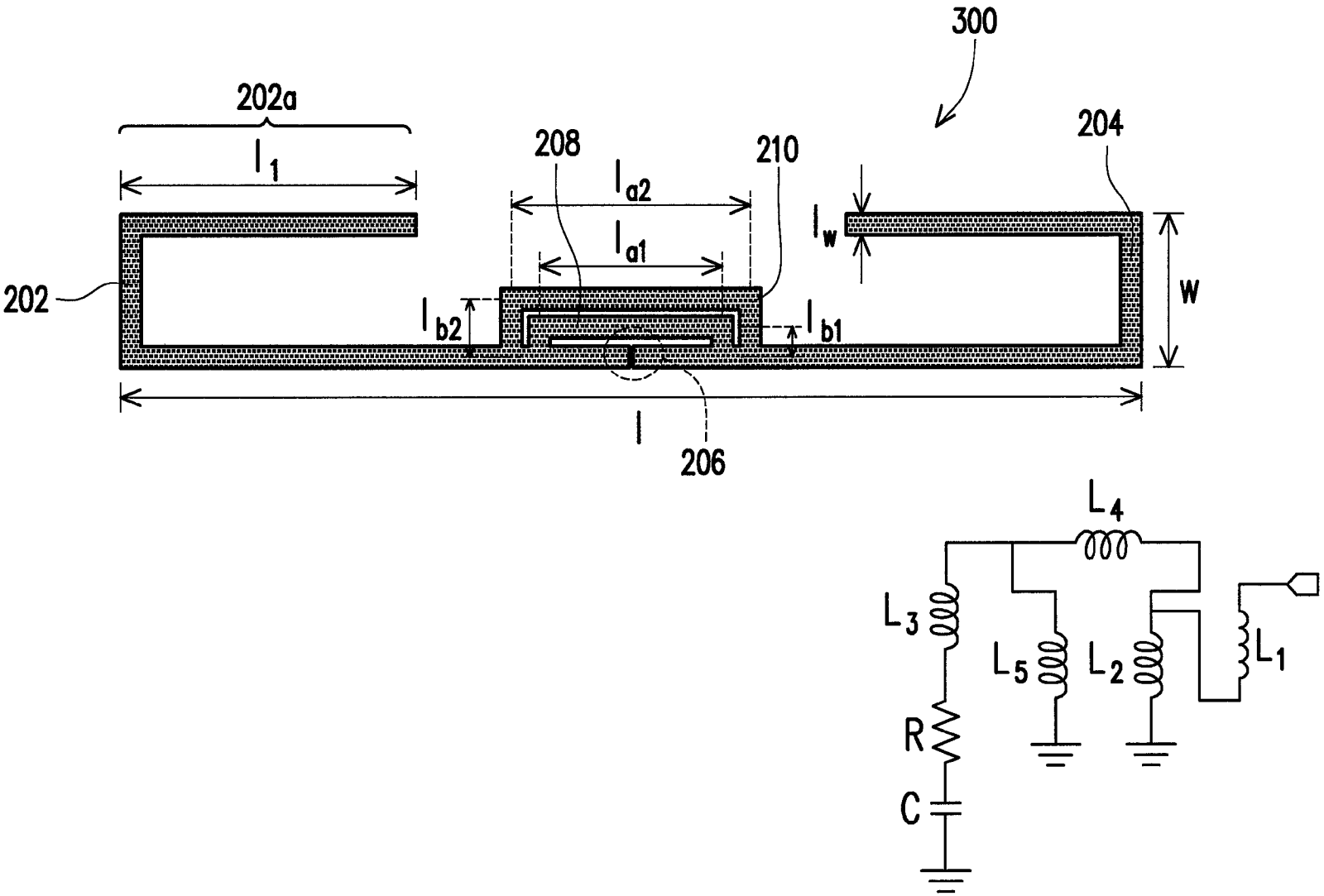
FIG. 5 is a schematic diagram illustrating a dipole antenna according to an embodiment of the present invention.

FIG. 5 is a schematic diagram illustrating a dipole antenna according to an embodiment of the present invention. Referring to FIG. 5, another mating loop 210 is added to the basic structure of the antenna 200 of FIG. 3 to form the dipole antenna 300, and an equivalent circuit thereof is shown at the right part of the figure. By applying the relatively large matching loop 210, the real part value (R) and the imaginary part value (X) of the input impedance Z can further be adjusted. The matching loop 210 can be disposed at a side different to that of the matching loop 208. However, the matching loop 210 is preferably disposed at peripheral of the matching loop 208, so as to save the antenna area. The matching loop 210 is used for increasing the bandwidth and the adjusting freeness of the real part and the imaginary part of the antenna impedance. A size of the matching loop 210 is, for example $l_{a2}$=24 mm and $l_{b2}$=6 mm.

Figure 6:
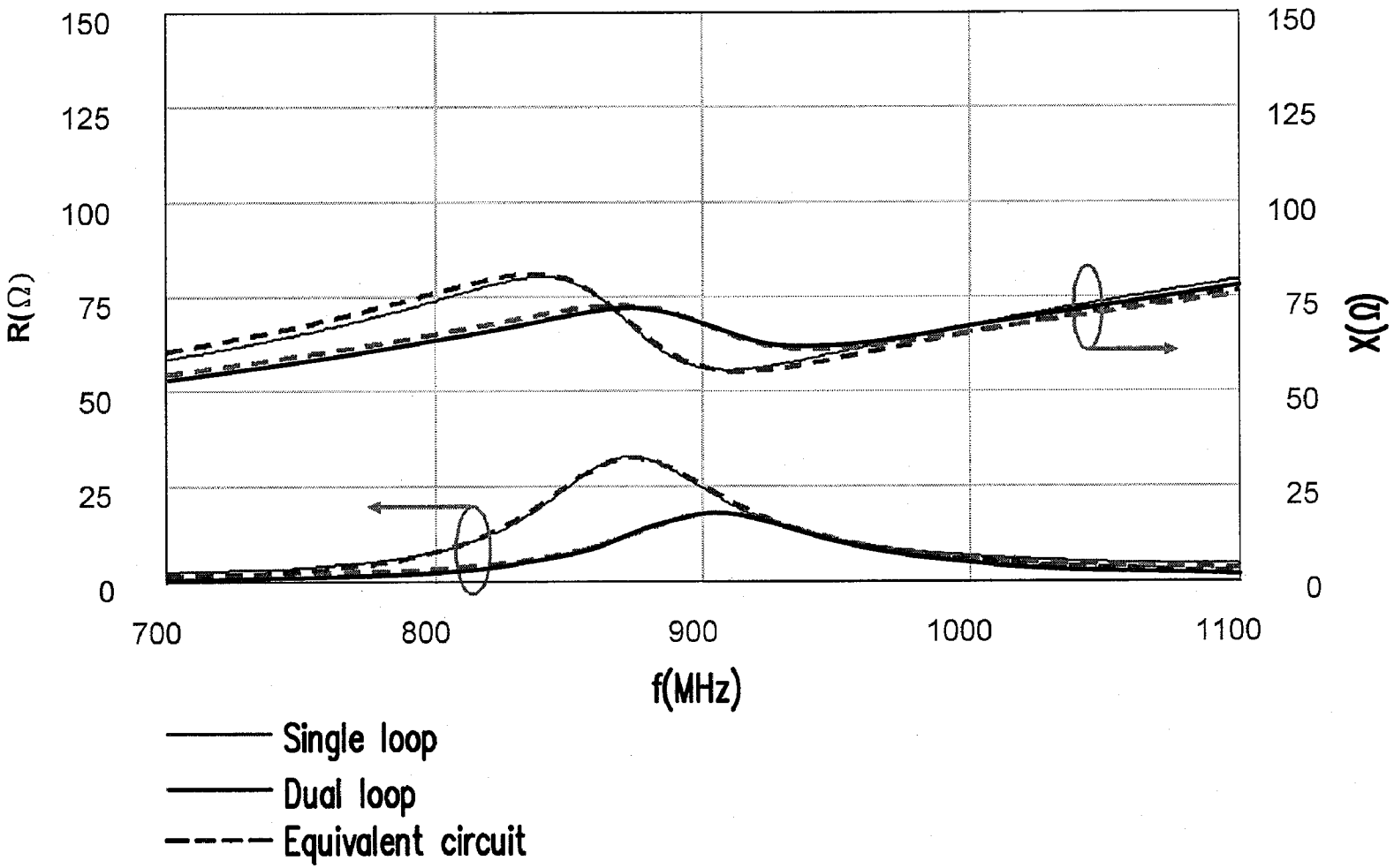
FIG. 6 is a schematic diagram illustrating an adjustment mechanism of a dipole antenna of FIG. 5.

FIG. 6 is a schematic diagram illustrating an adjustment mechanism of the dipole antenna of FIG. 5. Referring to FIG. 6, the fine lines represent variations of the real part and the imaginary part along with the frequencies in case that the antenna structure only has the matching loop 208, as shown in FIG. 3. The thick lines represent variations of the real part and the imaginary part along with the frequencies in case that the antenna structure has the matching loops 208 and 210, as shown in FIG. 5. The dash lines represent a simulation result of the corresponding equivalent circuit. Regarding the UFH band around a range of 900 MHz, application of the matching loop 210 can reduce the real part value (R) of the impedance, though a variation of the imaginary part (X) of the impedance is relatively small. Therefore, the real part value (R) and the imaginary part value (X) of the impedance can be preliminarily adjusted through the matching loop 208, wherein the imaginary part value (X) is mainly considered, which can be adjusted to approach the imaginary part value actually required by the chip impedance. Now, the real part value is probably overlarge. Then, the real part value (R) and the imaginary part value (X) of the impedance can be further adjusted through the matching loop 210. According to the characteristics shown in FIG. 6, the real part value (R) is mainly adjusted to reduce the real part value (R), while the imaginary part value (X) is approximately maintained. According to such antenna structure, the required impedance value is easy to be reached, and therefore a relatively great adjusting freeness can be achieved. Moreover, since the added matching loop 210 can slow down a variation of the impedances along with the frequencies, the antenna bandwidth can be increased.

Figure 7:
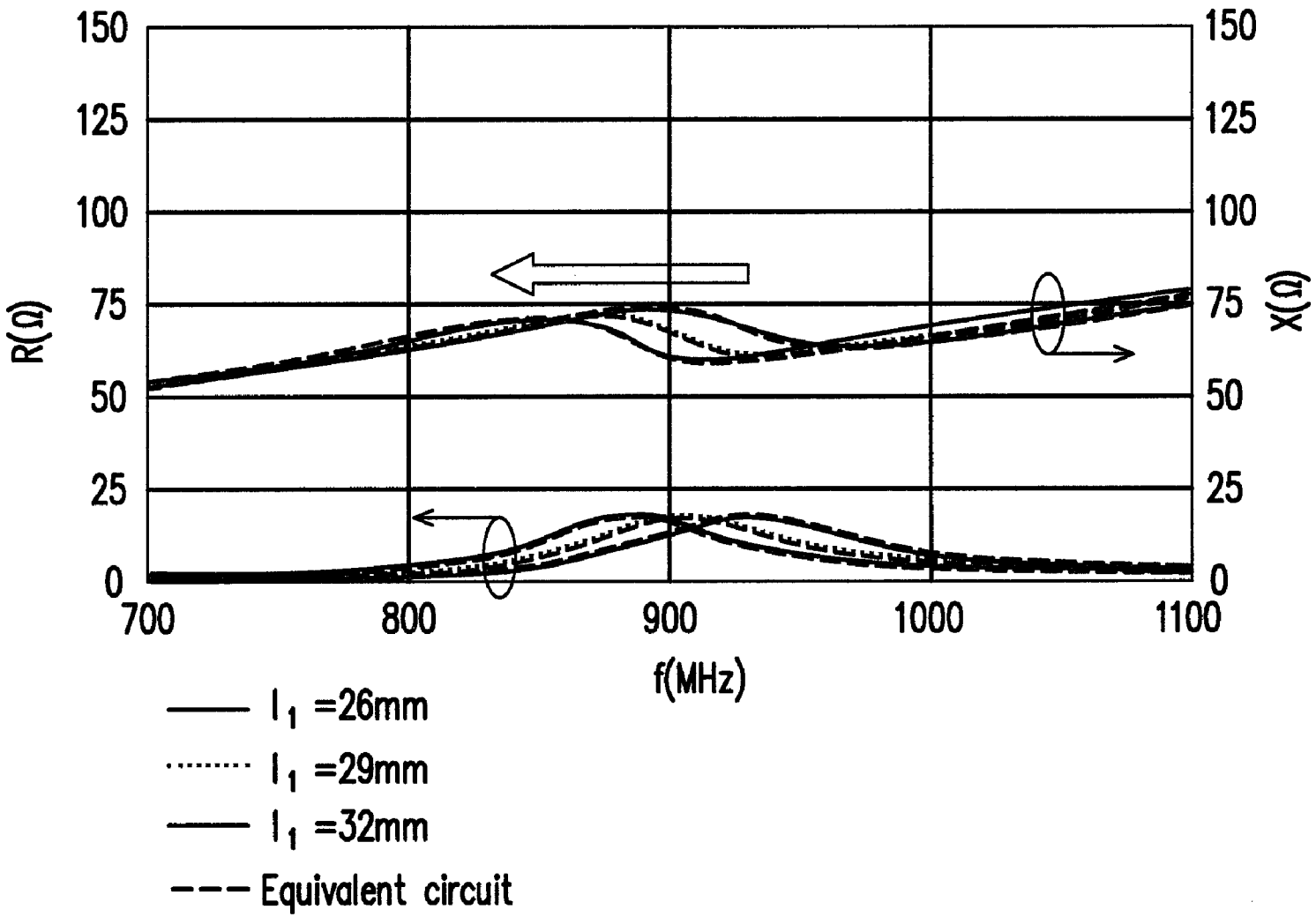
FIG. 7 is a schematic diagram illustrating effects caused by tail parts bending according to an embodiment of the present invention.

FIG. 7 is a schematic diagram illustrating effects caused by tail parts bending according to an embodiment of the present invention. Referring to FIG. 5 and FIG. 7, a main effect of changing the length $l_1$ of the bending region 202*a* is to adjust the operation frequency. The fine lines correspond to $l_1$=26 mm, the dot lines correspond to $l_1$=29 mm, and the thick lines correspond to $l_1$=32 mm. The dash lines represent a simulation result of the corresponding equivalent circuit. Shown as an arrow of the figure, if the parameter $l_1$ of the bending region 202*a* is increased, the corresponding operation frequency is then decreased.

Figure 8:
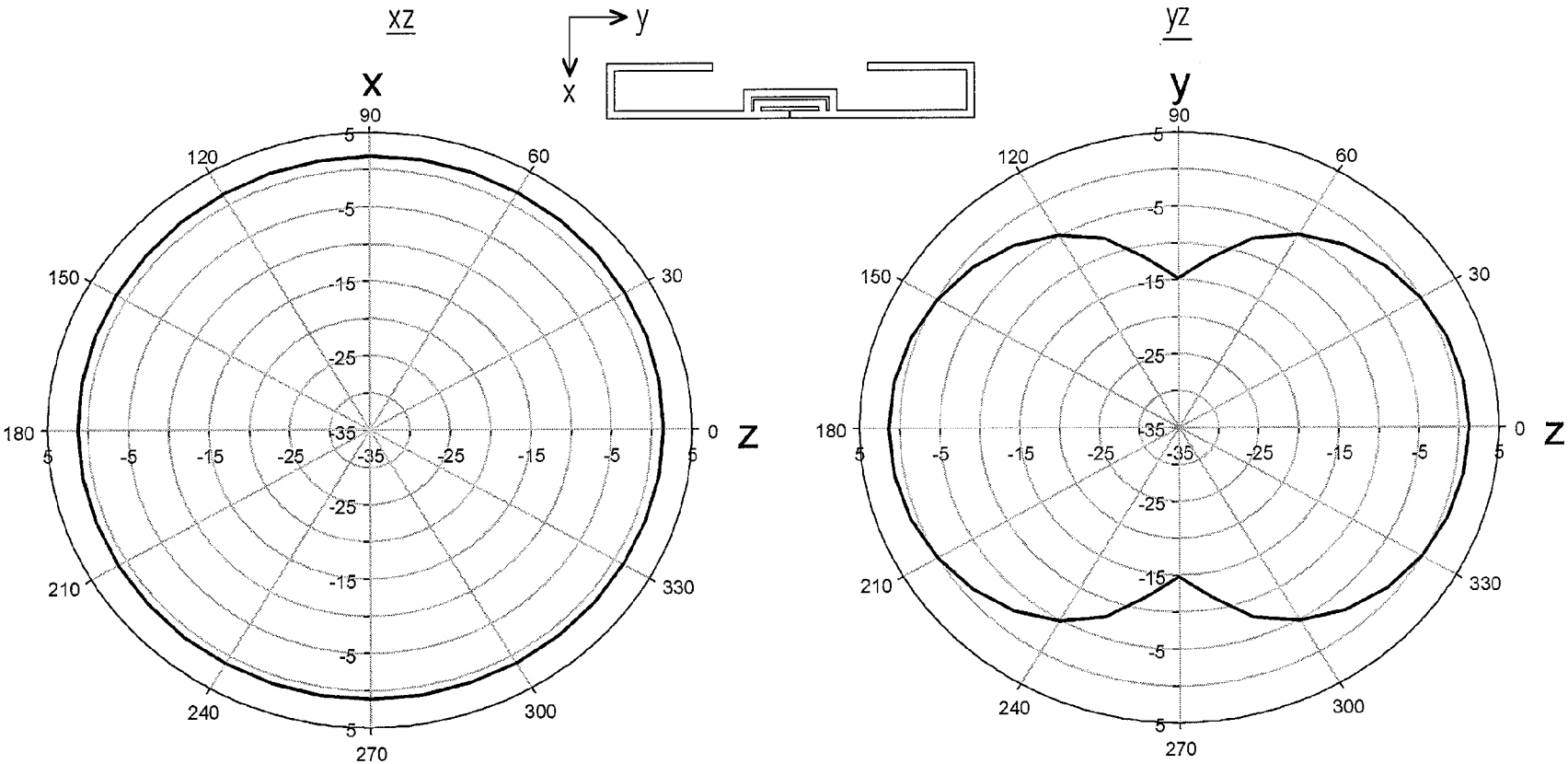
FIG. 8 is a simulation diagram of radiation patterns of a dipole antenna on two planes according to an embodiment of the present invention.

FIG. 8 is a simulation diagram of radiation patterns of a dipole antenna on two planes according to an embodiment of the present invention. Referring to FIG. 8, the radiation pattern on the left side is located on a XZ plane, and the radiation pattern on the right side is located on a YZ plane. In case that the operation frequency is 915 MHz, the chip input impedance is Zc=13.3−j64 ohm, and a preferable antenna impedance is Za=13.3+j64 ohm. A maximum antenna gain is, for example, 1.63 dB, and a radiation efficiency is 85.3%.

Figure 9:
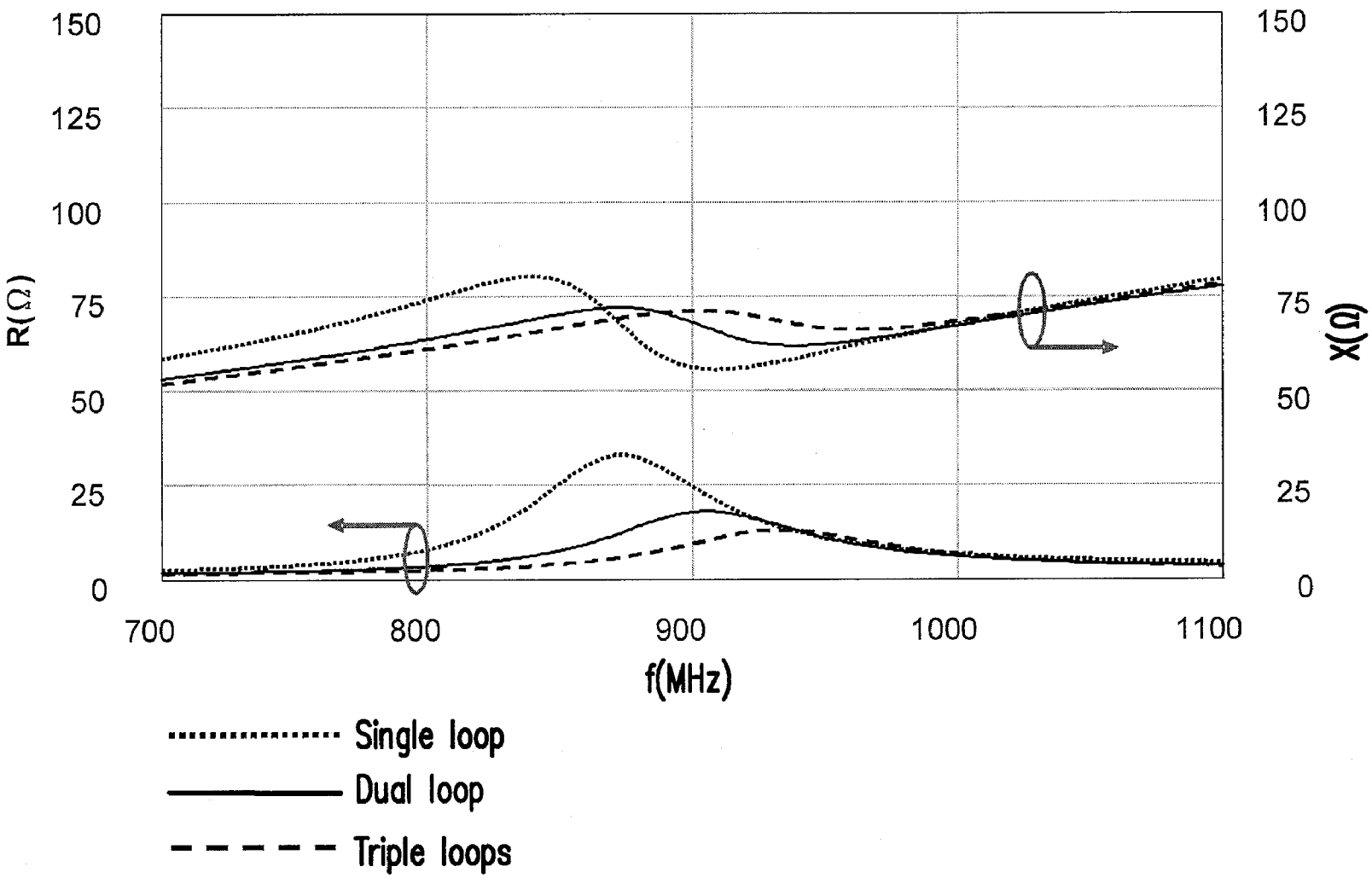
FIG. 9 is a simulation diagram illustrating effects of matching loops of a dipole antenna according to an embodiment of the present invention.

In the aforementioned embodiment, two matching loops are taken as an example. However, the present invention is not limited to the only two matching loops, and in an actual design, another matching loop can be added to form three matching loops. FIG. 9 is a simulation diagram illustrating effects of matching loops of a dipole antenna according to an embodiment of the present invention. Referring to FIG. 9, the dot lines represent a simulation result of a single matching loop, the solid lines represent a simulation result of dual matching loops, and the dash lines represent a simulation result of triple matching loops. In case that the operation frequency is 900 MHz, adding the matching loop can reduce the real part value, though the imaginary part value is approximately maintained unchanged, and the variation of the impedance is further slowed down, so that the bandwidth is increased.

Figure 10:
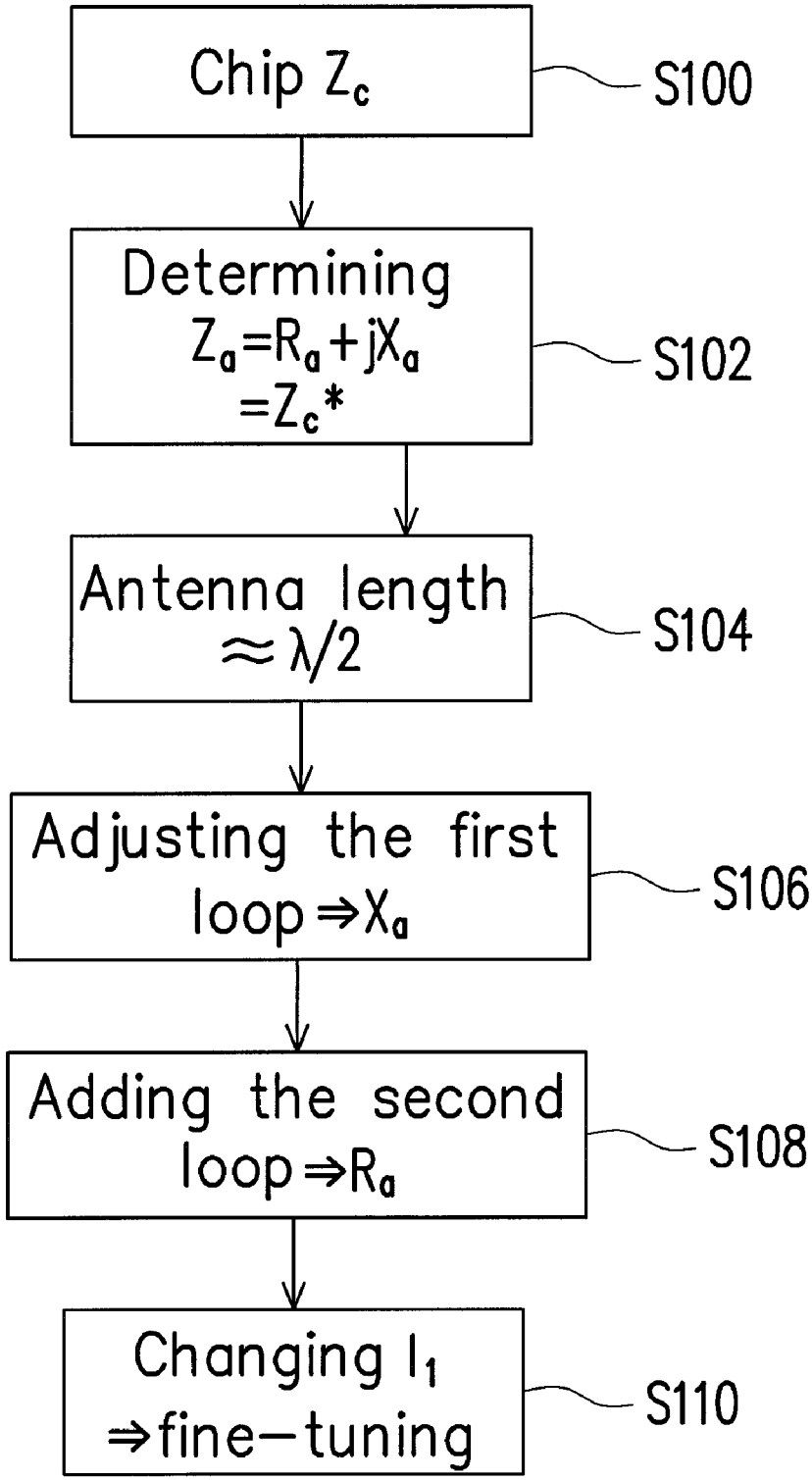
FIG. 10 is a flowchart illustrating a design of a dipole antenna according to an embodiment of the present invention.

FIG. 10 is a flowchart illustrating a design of a dipole antenna according to an embodiment of the present invention. Referring to FIG. 10, in step S100, the chip impedance Zc is determined. In step S102, the antenna impedance Za=Ra+jXa=Zc* is determined. Namely, the antenna impedance Za is a conjugated complex of the chip impedance Zc. In step S104, a length of the dipole antenna is determined. In step S106, a size of a first matching loop is adjusted, wherein the imaginary part value Xa of the impedance is first adjusted to approach the required value. In step S108, a second matching loop is added for mainly adjusting the real part value Ra of the impedance. In step S110, a size of the tail bending part $l_1$ is changed for fine-tuning characteristics of the antenna, for example, changing values of the inductor (La), resistor (Ra) and capacitor (Ca), etc. shown in FIG. 7, so as to match the required operation frequency.

Figure 11:
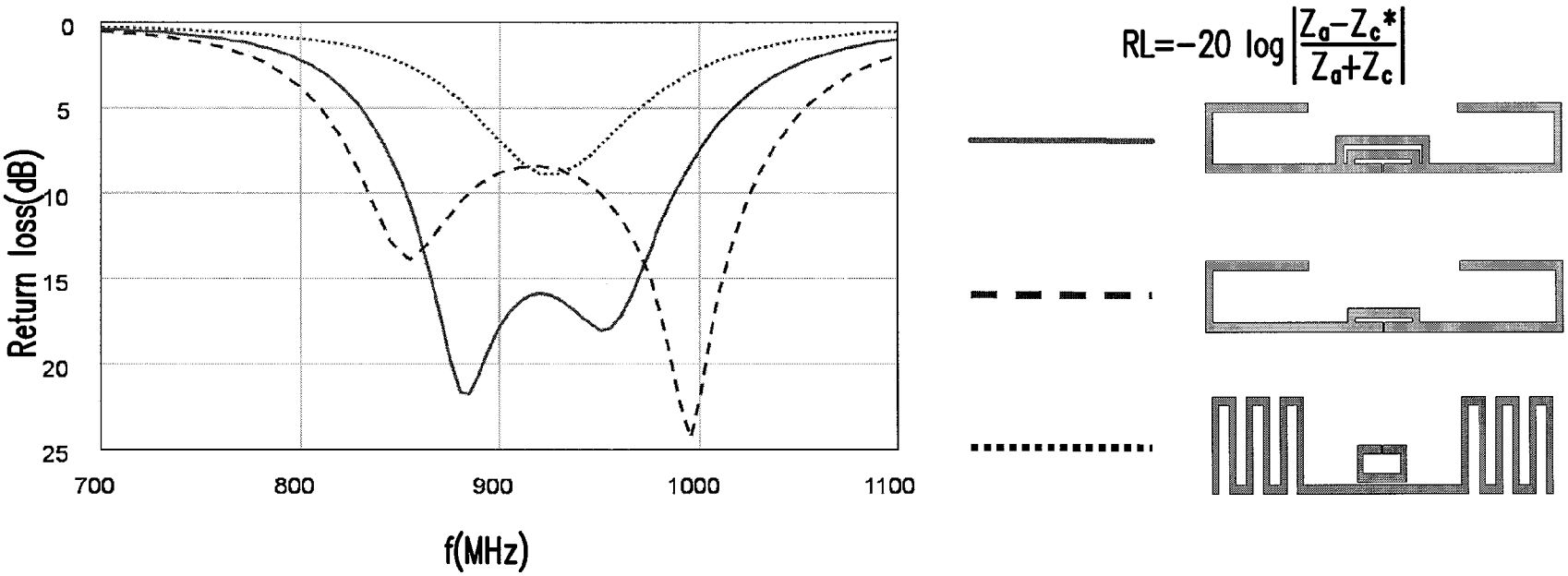
FIG. 11 is a schematic diagram illustrating frequency responses of simulating return loss of a dipole antenna according to an embodiment of the present invention.

FIG. 11 is a schematic diagram illustrating frequency responses of simulating return loss of a dipole antenna according to an embodiment of the present invention. Referring to FIG. 11, the frequency responses of three different antenna designs are compared. The solid line represents a design of the dual matching loops of the present invention, and a RL value thereof is:

$$RL = -20\log\left|\frac{Za - Zc^*}{Za + Zc}\right|.$$

The dash line represents a design of the single matching loop. The dot line represents the conventional antenna design. According to a characteristic of the frequency response, the design of dual matching loops of the present invention is suitable to be applied to the UHF band in case that the return loss thereof is 10 dB, and meanwhile a relatively great bandwidth can be achieved. In case that the dual matching loops are designed corresponding to the operation frequency of 915 MHz, the antenna impedance Za is Za=17.3+j64.2.

Figure 12:
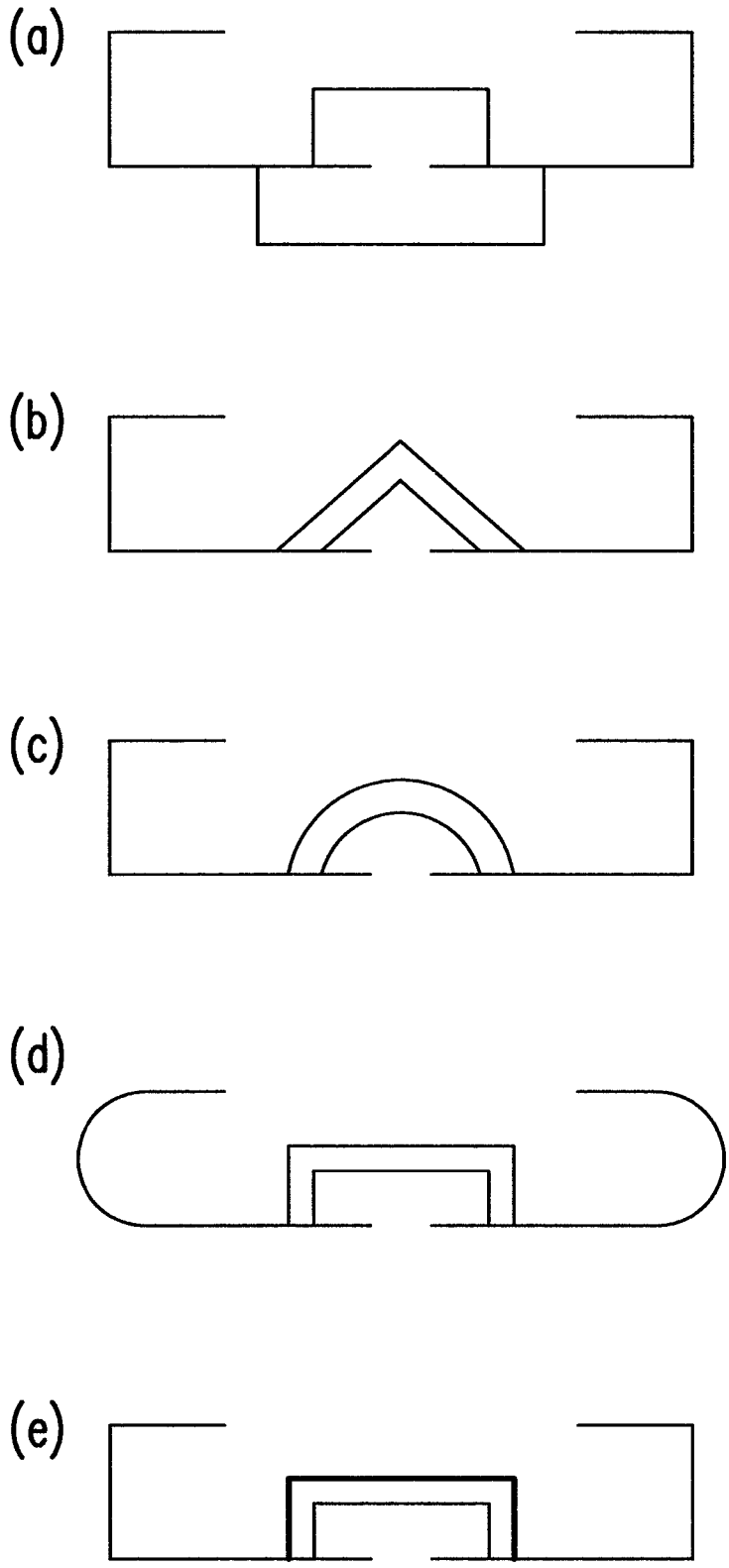
FIG. 12 is a schematic diagram illustrating variations of a dipole antenna according to an embodiment of the present invention.

FIG. 12 is a schematic diagram illustrating variations of the dipole antenna according to an embodiment of the present invention. Taking the dual matching loops as an example, referring to FIG. 12(*a*), the matching loops are unnecessarily to be overlapped. Referring to FIG. 12(*b*), shapes of the matching loops can be polygons, or can be triangles changed from rectangles. Moreover, the so-called rectangle generally refers to a rectangular quadrilateral, which includes a design of square, etc. Referring to FIG. 12(*c*), the shapes of the matching loops can be curves, for example, semicircles. Referring to FIG. 12(*d*), a bending mode of the tail part is neither limited to a rectangular bending, which can also be a curved bending, for example, a circular bending. Moreover, as described above, the line widths are unnecessarily to be equal, for example, line widths of the two matching loops are unnecessarily to be equal. Namely, for the whole antenna, at least a part of the line widths can be different. Actual variations of the antenna size of the present invention are not limited to the aforementioned embodiments, and the provided embodiments can also be mutually combined.

In the dipole antenna structure of the present invention, a plurality of the matching loops is applied to facilitate adjusting the impedance, so as to preferably match the chip impedance.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A dipole antenna, used in an operation frequency, comprising:

a dipole radiation main body, having a first radiation line arm and a second radiation line arm aligned in a straight line, wherein a gap exists therebetween to form a feeding terminal;

a first semi-loop metal line, having two ends respectively connected to the first radiation line arm and the second radiation line arm to form a first matching loop covering the feeding terminal; and a second semi-loop metal line, having two ends respectively connected to the first radiation line arm and the second radiation line arm to form a second matching loop, wherein the second matching loop is larger than the first matching loop.

2. The dipole antenna as claimed in claim 1, wherein the operation frequency is within a range of ultra-high frequency.

3. The dipole antenna as claimed in claim 1, wherein two tail parts of the first radiation line arm and the second radiation line arm are respectively a bending structure bent inside towards the feeding terminal.

4. The dipole antenna as claimed in claim 1, wherein two tail parts of the first radiation line arm and the second radiation line arm are respectively a rectangular bending structure bent inside towards the feeding terminal, which are used for shifting the operation frequency.

5. The dipole antenna as claimed in claim 1, wherein the first matching loop generates a real part value and an imaginary part value of an input impedance, and the second matching loop decreases the real part value, and approximately maintains the imaginary part value.

6. The dipole antenna as claimed in claim 1 further comprising a third semi-loop metal line having two ends respectively connected to the first radiation line arm and the second radiation line arm to form a third matching loop, wherein the third matching loop is larger than the second matching loop.

7. The dipole antenna as claimed in claim 1, wherein the dipole radiation main body, the first semi-loop metal line and the second semi-loop metal line all have a same line width.

8. The dipole antenna as claimed in claim 1, wherein the dipole radiation main body, the first semi-loop metal line and the second semi-loop metal line do not all have a same line width.

9. The dipole antenna as claimed in claim 1, wherein shapes of the first matching loop and the second matching loop are rectangles, curves or polygons.

10. The dipole antenna as claimed in claim 1, wherein the first matching loop and the second matching loop are a first rectangular matching loop and a second rectangular matching loop.

11. The dipole antenna as claimed in claim 10, wherein the second rectangular matching loop surrounds peripheral of the first rectangular matching loop.

12. The dipole antenna as claimed in claim 11 further comprising a third semi-rectangular metal line, wherein the semi-rectangular metal line has two ends respectively connected to the first radiation line arm and the second radiation line arm to form a third rectangular matching loop surrounding peripheral of the second rectangular matching loop.

13. The dipole antenna as claimed in claim 11, wherein the first rectangular matching loop generates a real part value and an imaginary part value of an input impedance, and the second rectangular matching loop decreases the real part value, and approximately maintains the imaginary part value.

14. The dipole antenna as claimed in claim 13, wherein the operation frequency is within a range of ultra-high frequency.

15. The dipole antenna as claimed in claim 14, wherein the operation frequency is about 915 MHz.

16. The dipole antenna as claimed in claim 11, wherein each of the first loop metal line and the second loop metal line has a same line width.

17. The dipole antenna as claimed in claim 11, wherein line widths of the first loop metal line and the second loop metal line are not totally the same.

* * * * *